US006850716B2

(12) United States Patent
Kurihara

(10) Patent No.: US 6,850,716 B2
(45) Date of Patent: Feb. 1, 2005

(54) IMAGE FORMING APPARATUS USING MULTIPLE REMOVABLE CARTRIDGES, INFORMATION PROCESSING APPARATUS USED TOGETHER WITH THIS APPARATUS, AND METHODS OF CONTROLLING THESE APPARATUS

(75) Inventor: Shukei Kurihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/359,614

(22) Filed: Feb. 7, 2003

(65) Prior Publication Data

US 2003/0152395 A1 Aug. 14, 2003

(30) Foreign Application Priority Data

Feb. 12, 2002 (JP) ..... 2002-034369

(51) Int. Cl.[7] ..... G03G 15/00

(52) U.S. Cl. ..... 399/27; 358/1.15; 399/8; 399/12; 399/227

(58) Field of Search ..... 399/8, 9, 12, 24, 399/25, 27, 28, 112, 223, 224, 226, 227; 358/1.15; 347/19

(56) References Cited

U.S. PATENT DOCUMENTS 5,689,772 A 11/1997 Fujiwara et al. ..... 399/106
5,768,660 A 6/1998 Kurihara et al. ..... 399/111
5,809,370 A 9/1998 Ueno ..... 399/81
5,870,654 A 2/1999 Sato et al. ..... 399/109
5,920,753 A 7/1999 Sasaki et al. ..... 399/111
6,137,971 A 10/2000 Sasaki et al. ..... 399/106
6,137,973 A 10/2000 Nishiuwatoko et al. ..... 399/111
6,141,508 A 10/2000 Sasaki et al. ..... 399/27
6,169,867 B1 1/2001 Kurihara ..... 399/123
6,317,145 B1 * 11/2001 Myung ..... 346/16
6,324,352 B1 * 11/2001 Suzuki ..... 399/227 X
2001/0043259 A1 * 11/2001 Ogata ..... 399/24 X
2003/0002080 A1 * 1/2003 Asauchi ..... 358/1.16
2003/0133719 A1 * 7/2003 Tsuruya et al. ..... 399/12

FOREIGN PATENT DOCUMENTS

JP 10-78740 3/1998

* cited by examiner

*Primary Examiner*—Sophia S. Chen
(74) *Attorney, Agent, or Firm*—Fitzpatrick, Cella, Harper & Scinto

(57) ABSTRACT

An image forming apparatus that uses a plurality of removable cartridges and that is so adapted that a desired cartridge can be exchanged with ease. The apparatus includes a cartridge management unit which, in accordance with a command supplied from a move-cartridge designating unit of a host computer, causes movement of cartridges possessed by an image forming unit.

25 Claims, 12 Drawing Sheets

IMAGE FORMING APPARATUS USING MULTIPLE REMOVABLE CARTRIDGES, INFORMATION PROCESSING APPARATUS USED TOGETHER WITH THIS APPARATUS, AND METHODS OF CONTROLLING THESE APPARATUS

FIELD OF THE INVENTION

This invention relates to an image forming apparatus that uses a plurality of removable cartridges, an information processing apparatus capable of controlling this image forming apparatus, methods of controlling these apparatus and control programs therefor.

BACKGROUND OF THE INVENTION

In order to facilitate maintenance of a conventional printer that employs electrophotography as well as communications equipment and copiers that use such a printer, often use is made of a removable cartridge within which a consumable such as toner is sealed.

FIG. 2 is a block diagram illustrating an example of the hardware configuration of a typical color-image forming apparatus 30 that uses color cartridges of different colors.

As shown in FIG. 2, the apparatus includes a host interface 1 through which the image forming apparatus 30 communicates with a host computer, which is not shown. A communication signal from the image forming apparatus 30 to the host computer is output to the latter via the host interface 1. A communication signal from the host computer to the image forming apparatus 30 enters the latter through the host interface 1.

A host communication line 2 is used as the communication medium between the image forming apparatus 30 and the host computer. Data, e.g., image processing information, which enters the image forming apparatus 30 as code data via the host interface 1 first is stored in a receive buffer RAM 4, which receives data from the host computer, under the control of a CPU 3. The receive buffer RAM 4 stores character code, graphic forming information and control information, etc., in the order in which these are sent from the host interface 1.

A font memory 9 stores character pattern data in association with character codes.

A processing program such as an interpreter that analyzes the code data such as character code, graphic forming information and control information and forms a dot pattern has been stored in a program ROM 6. In accordance with the processing program, the CPU 3 reads corresponding character pattern data out of the font memory 9 based upon the character code data that has been stored in the receive buffer RAM 4, and expands this data into a pattern in a dot-pattern memory 10.

A control program for exercising overall control of the image forming apparatus 30 is stored in the program ROM 6, and the CPU 3 controls the overall image forming apparatus 30 in accordance with this program.

A work random-access memory (working RAM) 5 is a memory for writing and reading various data temporarily. This memory is utilized while the CPU 3 is executing processing in accordance with the program stored in the program ROM 6.

The dot-pattern memory 10 is a memory for storing data-pattern data that has been expanded into a pattern by the processing program stored in the program ROM 6 in order to form the dot pattern.

The dot-pattern data from the dot-pattern memory 10 is input to the FIFO (First In, First Out) memory 7, which outputs this data to an interface 8 for an image forming unit 20.

The interface 8 sends the image data (dot-pattern data) from the FIFO memory 7 to the image forming unit 20. The latter forms the image data, which has been received via the interface 8, on a recording medium such as paper by a well-known electrophotographic method, thereby producing an output of the image.

A control panel 13 such as a keyboard or touch-sensitive panel is used by the operator to make inputs for configuring the operating environment of the image forming apparatus 30. For example, the control panel 13 is to set the on-line/off-line status of the host interface 1.

A sensor 14 for a toner-cartridge exchange button senses that the operator has pressed a toner-cartridge exchange button disposed on the image forming apparatus 30 proper or on the control panel 13.

Signals that enter from the control panel 13 and button sensor 14 are input to a data bus 15 and address bus 16 via a control-panel interface 12. It should be noted that the configuring of the operating environment of the image forming apparatus 30 can be performed not only by the control panel 13 but also from the host computer via the host interface 1.

An environment configuring memory 11 comprising a non-volatile read/write memory (referred to as an "NVRAM" below) saves various operating environment settings of the image forming apparatus 30.

A sensor 18 for a toner-cartridge exchange cover senses whether a cover for exchanging toner cartridges used by the image forming unit 20 is open or closed.

A toner-cartridge sensor 19 senses which toner cartridge [either a Y (yellow), M (magenta), C (cyan) or K (black) cartridge] is presently situated at a removal port as well as the amount of toner remaining in the cartridge.

A clock signal that is output from a clock generating circuit 17 is used as the clock signal of the CPU 3.

It is assumed that the color-image forming apparatus shown in FIG. 2 requires toners of the four colors Y (yellow), M (magenta), C (cyan) and K (black) for the purpose of forming color images. In general, a toner cartridge is provided for each of the colors so that the toner cartridges for the individual colors can be replaced and replenished one at a time.

When such a color toner cartridge is exchanged, as shown in FIG. 4, a cylindrical supporting body 40 that supports the toner cartridges of the individual colors must be moved from a position (A) for when an image is formed to a position (B) for exchanging the toner cartridge (this is performed in a toner-cartridge exchange mode). Further, since only a single toner cartridge generally can be exchanged at one time at the toner-cartridge removal port, it is necessary to rotate the supporting body 40 in such a manner that the color toner cartridge to be exchanged will arrive at the removal port.

In the conventional image forming apparatus, the main body of the apparatus is provided with the toner-cartridge exchange button, as mentioned above. The supporting body 40 rotates through a predetermined angle in a predetermined direction in response to depression of the toner-cartridge exchange button. Whenever the supporting body 40 is thus rotated, the color toner cartridges move to the toner-cartridge removal port one after another.

The user who is exchanging a toner cartridge presses the toner-cartridge exchange button until the desired color toner cartridge moves to the removal port. The user then exchanges the cartridge.

The toner-cartridge exchange button and its related control function, which are not used frequently, result in higher cost for parts.

Further, if the toner-cartridge exchange button is mounted at an exposed location on the apparatus surface, such as on the control panel, there is a possibility that the button will be pressed by the user accidentally during image formation processing or at the time of an anomaly. This makes it difficult to create the control program and to deal with exception handling.

Further, the positional relationship between the color toner cartridge desired to be exchanged and the toner-cartridge removal port differs from one time to another. In certain cases, therefore, replacing a toner cartridge becomes a laborious task. For example, if the supporting body 40 rotates through ¼ of a revolution counter-clockwise in FIG. 4 whenever the toner-cartridge exchange button is pressed, then, in order to exchange the black toner cartridge (K), the toner-cartridge exchange button must be pressed three times to move the toners in the order cyan (C), magenta (M) and black (K) so that the black toner cartridge will arrive at the removal port.

According to a method proposed heretofore, the opening and closing of the toner-cartridge exchange cover is used instead of depression of the toner-cartridge exchange button. Though this method is advantageous to a certain extent in that it prevents erroneous operation, labor is still involved in moving the cartridge desired to be exchanged. Hence, there is still room for improvement.

SUMMARY OF THE INVENTION

Accordingly, an object of the present invention is to remove the problems of the prior art.

According to the present invention, there is provided an image forming apparatus having a plurality of removable cartridges and a cartridge support for supporting the plurality of cartridges, the apparatus comprising cartridge support moving means for moving the cartridge support and placing one of the plurality of cartridges at a detachable position when a cartridge supported on the cartridge support is to be removed from the image forming apparatus, and control means for controlling operation of the cartridge support moving means if a cartridge-move command issued by an external unit has been received.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

(Configuration of Image Forming System)

Figure 1:
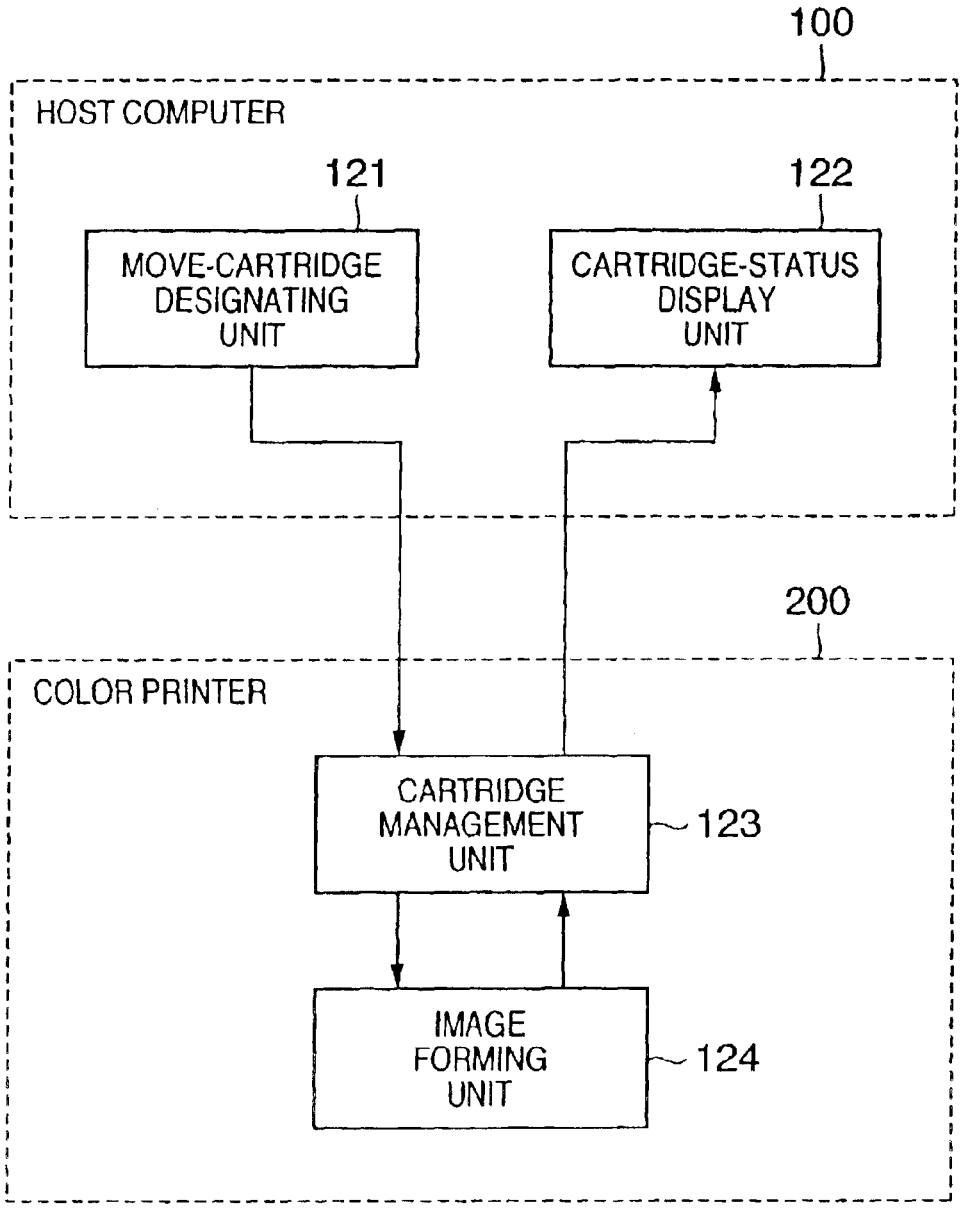
FIG. 1 is a block diagram illustrating an example of the configuration of an image forming system that employs a host computer, which serves as an example of an information processing system according to the present invention, and a color printer serving as an example of an image forming apparatus according to the present invention.

FIG. 1 is a diagram illustrating an example of the configuration of an image forming system that employs a host computer 100, which serves as an example of an information processing system according to the present invention, and a color printer 200 serving as an example of an image forming apparatus according to the present invention.

The host computer 100 controls the color printer 200 and causes the color printer 200 to output desired data. The color printer 200 has a plurality of toner cartridges. Upon receiving a command from the operator specifying which of the toner cartridges is desired to be removed, a move-cartridge designating unit 121 converts the command to a command that can be interpreted by the color printer 200 and applies this command to the color printer 200.

A cartridge-status display unit 122 receives cartridge information sent from a cartridge management unit 123 of the color printer 200 and displays which color cartridge is presently located at the removal port and whether the present mode is the toner-cartridge exchange mode.

The cartridge management unit 123 of the color printer 200 acquires cartridge information from an image forming unit 124 in which the toner cartridges have been loaded. The cartridge information indicates whether the present mode is the toner-cartridge exchange mode and, if the present mode is the toner-cartridge exchange mode, indicates which cartridge is located at the removal port. Further, using a command received from the move-cartridge designating unit 121 and cartridge information acquired from the image forming unit 124, the cartridge management unit 123 decides and executes processing necessary for moving the cartridge specified by the command to the removal port. The details of processing executed when exchanging a toner cartridge will be described later.

(Structure of Host Computer)

In this embodiment, the host computer 100 can be implemented by a general-purpose computer, such as an ordinary personal computer, that is capable of communicating with the color printer 200.

Figure 3:
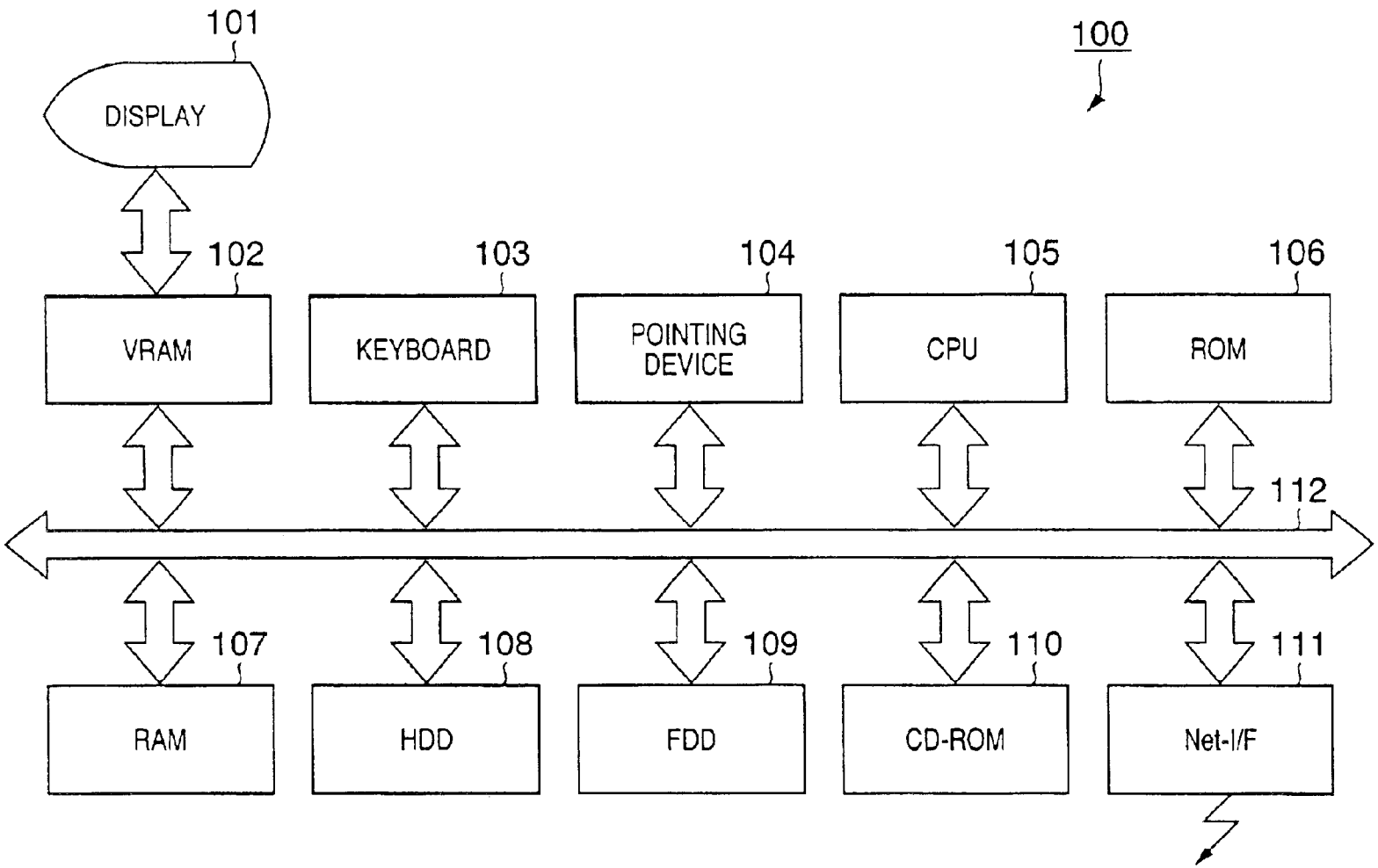
FIG. 3 is a block diagram illustrating an example of the structure of a computer capable of being utilized as a host computer according to an embodiment of the invention.

FIG. 3 is a block diagram illustrating an example of the structure of a computer capable of being utilized as the host computer 100 according to this embodiment of the invention.

As shown in FIG. 3, the computer includes a display 101 for displaying information related to data being processed by an application program as well as various messages and menus. The display 101 is constituted by a CRT (cathode-ray tube) or LCD (liquid crystal display), etc. A video RAM (referred to as a "VRAM" below) 102 expands an image displayed on the display screen of the display 101. A keyboard 103 and pointing device 104 are used to enter characters and the like on the display screen and to designate icons and buttons, etc., of a GUI (Graphical User Interface). A CPU 105 administers overall control of the computer.

A ROM (Read-Only Memory) 106 stores an operation processing procedure (program) executed by the CPU 105. An application program and error processing program relating to various data processing, as well as a program relating to a flowchart described below, have been stored in the ROM 106. A RAM (Random-Access Memory) 107 is used as a work area for when the various programs mentioned above are executed by the CPU 105, and as a temporary-save area for when error processing is executed.

The computer further includes a hard-disk drive (HDD) 108 and a floppy-disk drive (FDD) 109 that are used as storage areas for an operating system and device drivers, as well as for application programs, data and libraries. Instead of or in addition to the floppy-disk drive, it is permissible to provide a storage device that employs removable memory media such as a magneto-optic disk or flash memory.

A CD/DVD-ROM/R/RW drive 110 is for reading and writing CD/DVD-ROM/R/RW media. In addition, when necessary it is permissible to provide an external storage device such as a magnetic tape drive, examples of which are a tape streamer and a DDS.

A network interface 111 is for connecting the computer to a computer network such as the Internet. A bus 112 (which comprises an address bus, data bus and control bus) connects the units mentioned above. In addition to the network interface 111, the computer may have a serial interface such as an RS-232C, RS-422, USB (Universal Serial Bus) or IEEE 1394 and a parallel interface such as an IEEE 1284 so that the computer can be connected to external devices such as a modem or printer.

By employing the operating system and the necessary driver software, etc., this general-purpose computer communicates with other devices on a computer network or public telephone network through use of a router (inclusive of a dial-up router), which is connected via the network interface 111, and a modem or TA, etc., connected via a serial interface.

By way of example, the cartridge-status display unit 122 in FIG. 1 is used as the display 101, and the move-cartridge designating unit 121 is implemented by having the CPU 105 execute a program that has been stored in a storage device such as the ROM 106 or hard-disk drive 108. Further, the connection between the host computer 100 and color printer 200 may be a local connection via a serial or parallel interface, or a remote connection via the network interface 111. The connection used should be decided in accordance with the communication interface (host interface 1 in FIG. 2) possessed by the color printer 200.

(Structure of Color Printer 200)

Figure 2:
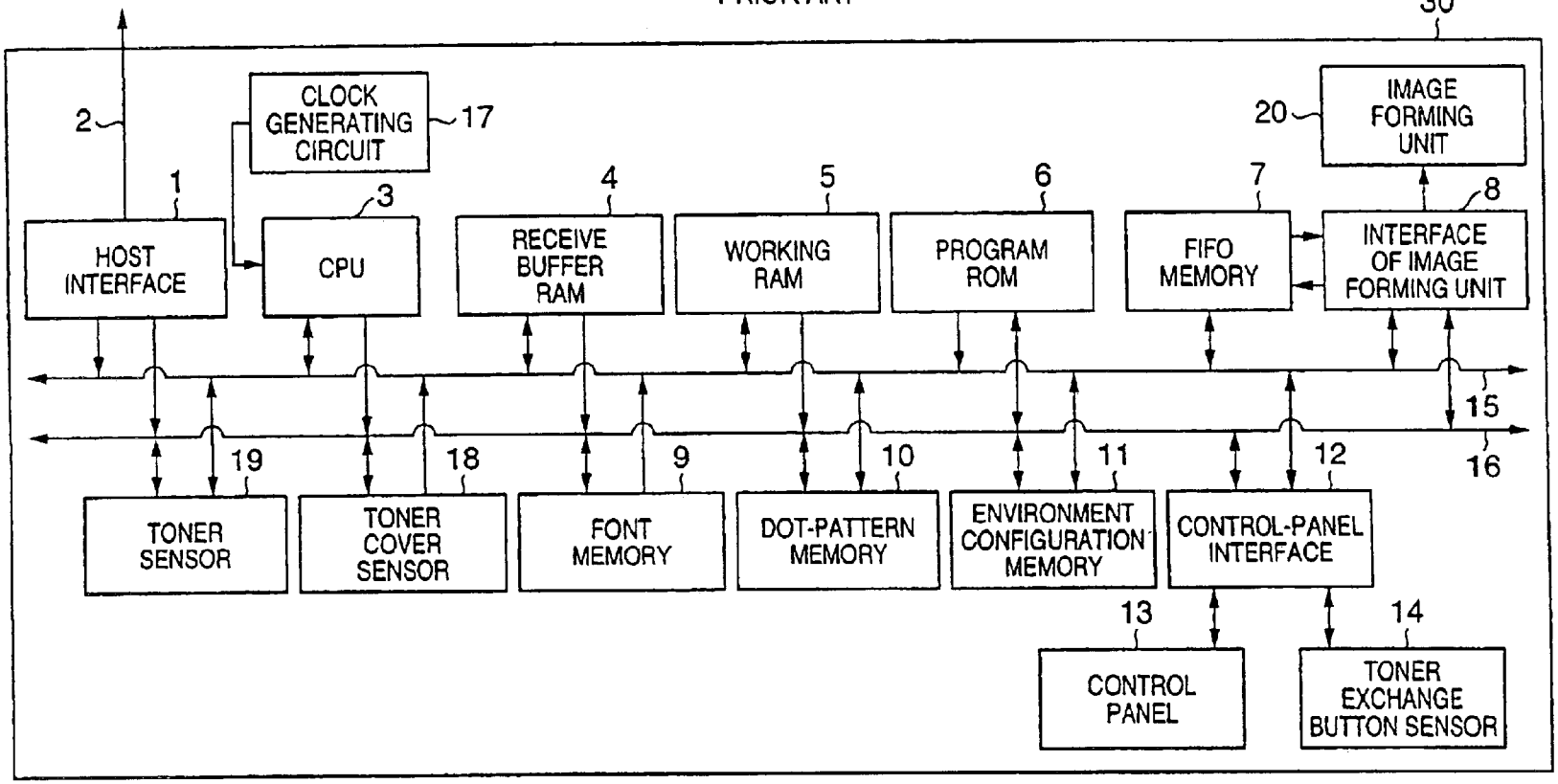
FIG. 2 PRIOR ART
FIG. 2 is a block diagram illustrating an example of the hardware configuration of a typical color image forming apparatus according to the prior art.

The structure of the color printer 200 in this embodiment basically is the same as that of the conventional color printer 30 shown in FIG. 2 with the exception that the toner-cartridge exchange button and related components, specifically the sensor 14 of the toner-cartridge exchange button, are unnecessary. In the color printer 200 having this structure, the image forming unit 124 of FIG. 1 can be implemented by the image forming unit 20 of FIG. 2 and the cartridge management unit 123 can be implemented by having the CPU 3 execute the control program that has been stored in the program ROM 6.

(Processing on Side of Host Computer 100)

Figure 5:
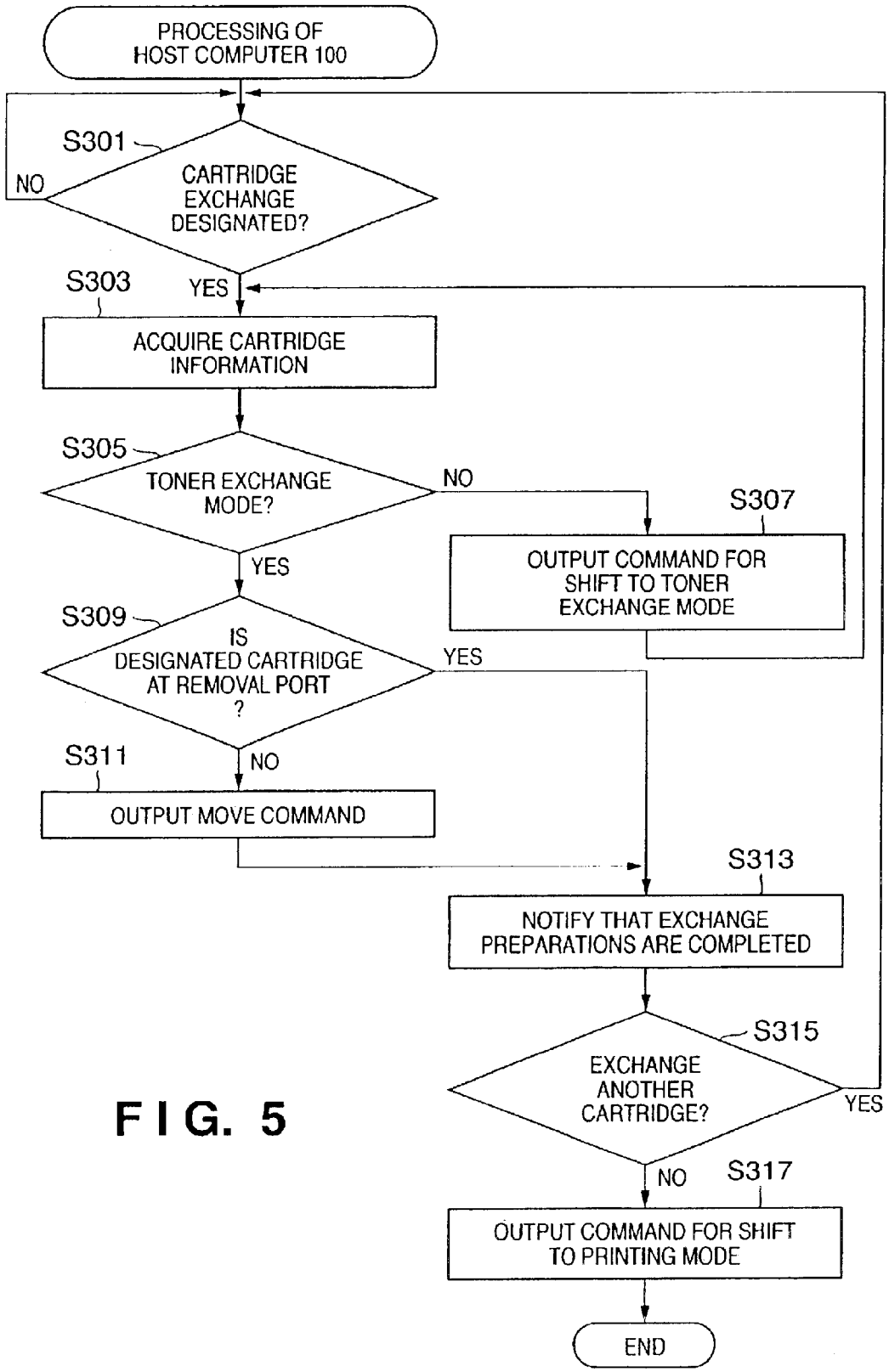
FIG. 5 is a flowchart illustrating the processing executed by the host computer according to a first embodiment of the present invention.
Figure 6:
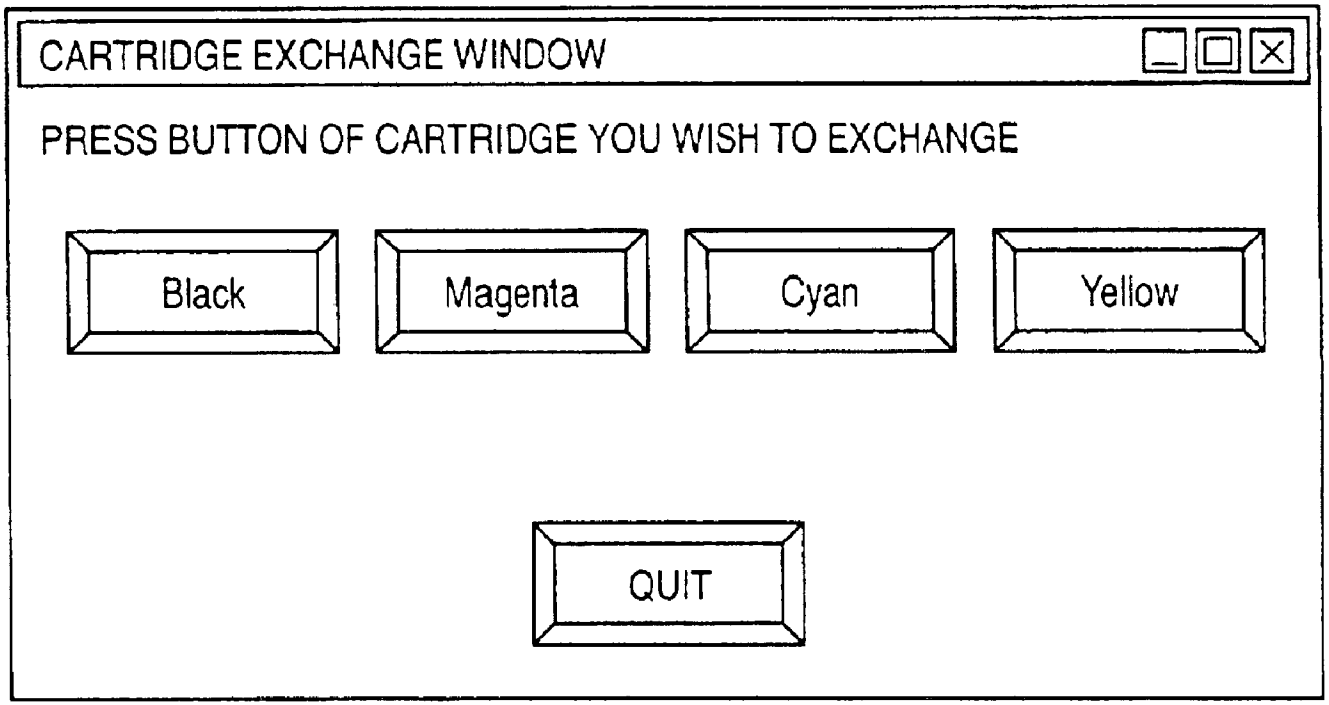
FIG. 6 is a diagram showing an example of a GUI screen, which is for specifying a cartridge to be exchanged, presented to the user by the host computer.

FIG. 5 is a flowchart illustrating processing executed by the host computer 100 of this embodiment when a cartridge of the color printer 200 is exchanged. The processing shown in FIG. 5 can be implemented under conditions in which, by way of example, the host computer 100 presents the user with the screen of a GUI for specifying cartridge exchange. FIG. 6 illustrates an example of a GUI screen for specifying a cartridge to be exchanged.

By way of example, this GUI screen is capable of being called from the GUI screen of a program (printer-driver program), which has been installed in the host computer 100, for controlling the color printer 200. Of course, an equivalent GUI screen can be presented to the user by any other method, such as by executing an application exclusively for cartridge exchange.

First, at step S301 in FIG. 5, the host computer waits for the user to specify on the GUI of FIG. 6 the cartridge desired to be exchanged. Specifying a cartridge is performed by using a mouse, for example, to click on whichever button among Black, Cyan, Magenta and Yellow buttons corresponds to the cartridge desired to be exchanged. If the fact that a cartridge has been specified is sensed, the move-cartridge designating unit 121 outputs a cartridge-information acquisition command to the color printer 200 and obtains cartridge information sent back from the cartridge management unit 123 (step S303). Based upon mode information contained in the cartridge information, the move-cartridge designating unit 121 detects whether the color printer 200 is in the toner-cartridge exchange mode or a printing mode (step S305).

If the prevailing mode is not the toner-cartridge exchange mode ("NO" at step S305), then a command for shifting to the toner-cartridge exchange mode is output and the color printer 200 makes the transition to the toner-cartridge exchange mode (step S307), after which control returns to step S303.

If the color printer 200 is in the toner-cartridge exchange mode ("YES" at step S305), however, then it is determined whether the cartridge designated at step S301 is situated at the toner-cartridge removal port (step S309). If the designated cartridge is not situated at the toner-cartridge removal port ("NO" at step S309), then the type of designated cartridge and a command to move the toner cartridge to the removal port are issued and the color printer 200 is instructed to move the cartridge (step S311).

Figure 7:
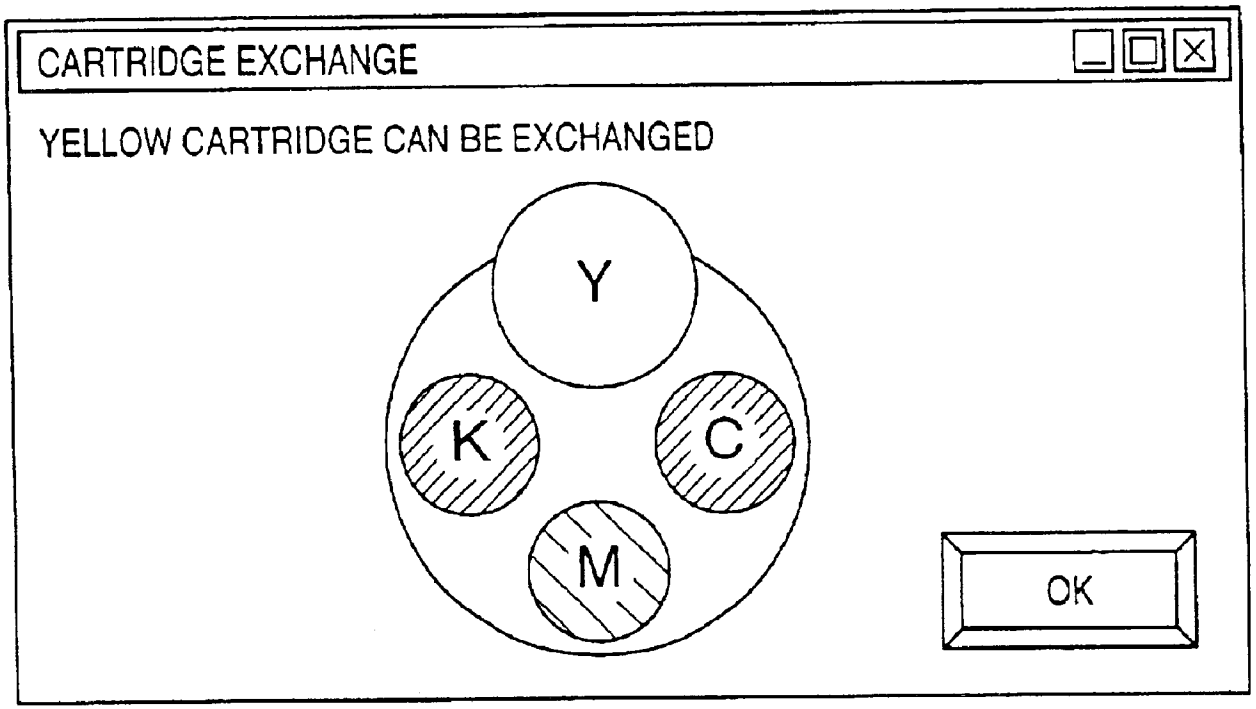
FIG. 7 is a diagram illustrating a screen of the host computer for notifying the user that preparations for exchanging a toner cartridge have been completed.

If the designated cartridge is already situated at the toner-cartridge removal port ("YES" at step S309), on the other hand, then the user is notified that exchange of the toner cartridge is possible (step S313). This notification may be given by any method. For example, a screen of the kind shown in FIG. 7 can be displayed on the display 101.

By way of example, if the user exchanges a toner cartridge and then indicates that processing for exchanging the cartridge is to be terminated, as by clicking on a "QUIT" button displayed on the screen shown in FIG. 6 (step S315), then a command for shifting to the printing mode is output to cause the color printer 200 to make the transition to the printing mode (step S317). In a case where exchange of a toner cartridge has been designated from the designating screen, control returns to step S301 and the above-described processing is repeated.

In a case where the color printer 200 has been adopted so as to shift to the printing mode automatically when a cover for exchanging a toner cartridge is opened, output of the command for shifting to the printing mode at step S317 is unnecessary. In such case it will suffice to modify the processing of FIG. 5. Specifically, after notification is given at step S313 of the fact that preparations for exchange have been completed, control would return to step S301 if an "OK" button is clicked on the notification screen.

(Processing on Side of Color Printer 200)

Figure 8:
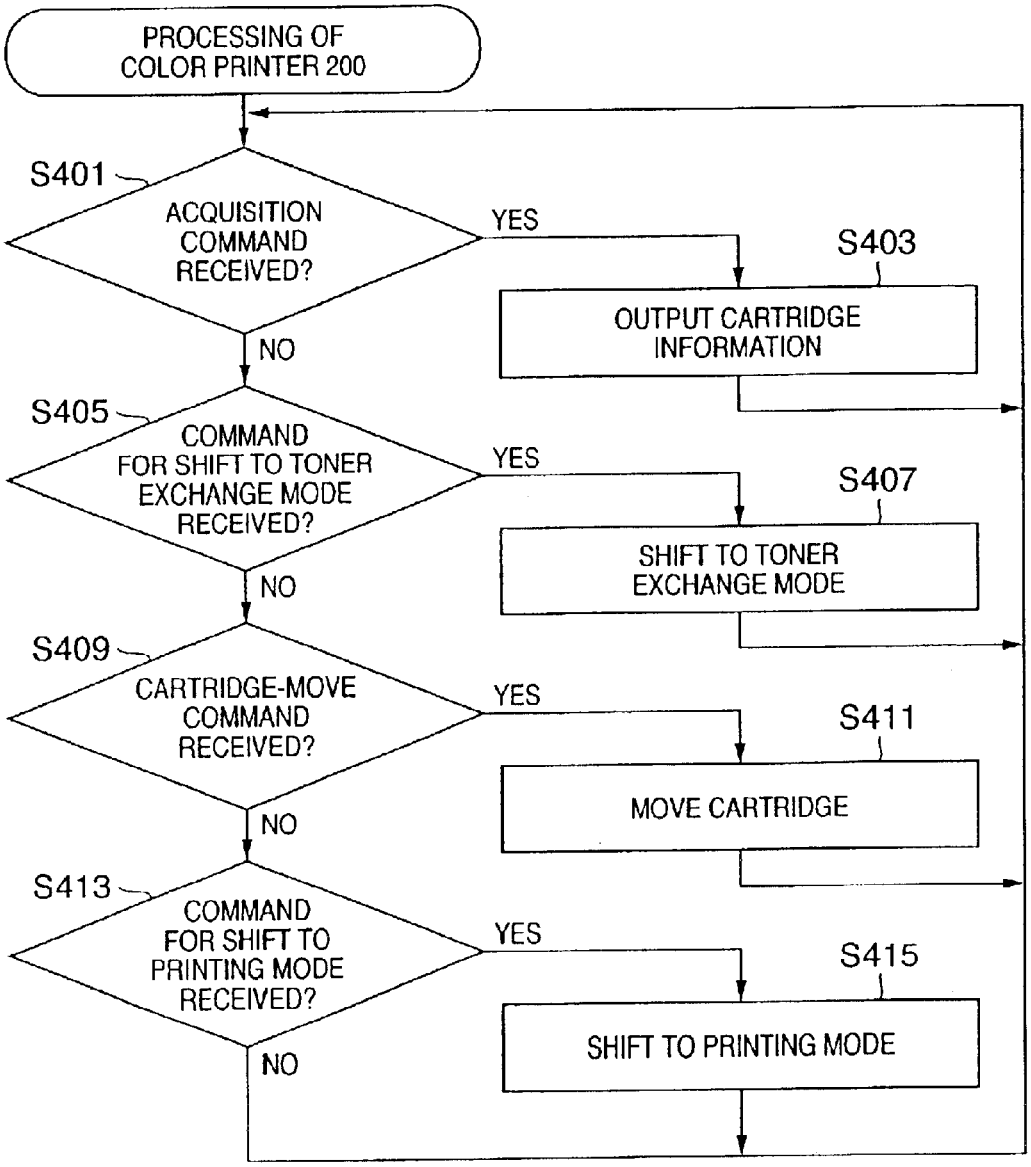
FIG. 8 is a flowchart illustrating the processing executed by a color printer according to the first embodiment.

FIG. 8 is a flowchart illustrating processing executed by the color printer 200 of this embodiment when a cartridge is exchanged.

As shown in FIG. 8, the color printer 200 according to this embodiment executes various processing steps in accordance with commands received in a command-standby state. The color printer 200 discriminates the types of received commands at steps S401, S405, S409 and S413 and executes processing corresponding to respective ones of these commands at steps S403, S407, S411 and S415. After each of the latter processing steps, control returns to the command-standby state.

Figure 9:
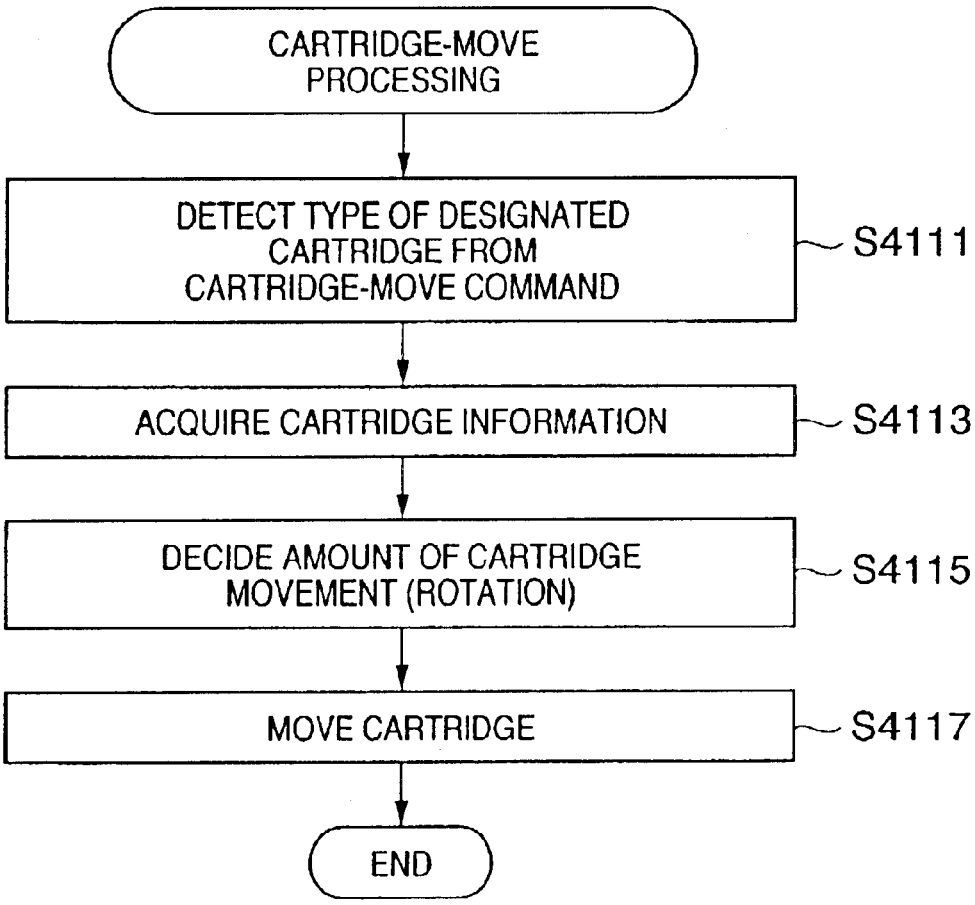
FIG. 9 is a flowchart illustrating the processing in FIG. 8 for moving cartridges.

FIG. 9 is a flowchart illustrating an example of processing (step S411 in FIG. 8) for moving a cartridge.

First, the type of cartridge that has been designated is detected from a cartridge-move command that has been received (step S4111). Information relating to the present cartridge is acquired from the image forming unit 124 (step S4113) and the amount of movement of the cartridge supporting body (the amount of rotation of the supporting body in the case of the cartridge supporting body of this embodiment) necessary to move the cartridge specified by the command to the cartridge removal port is decided (step S4115). The cartridge supporting body is then moved in accordance with the amount of movement decided (step S4117).

(Second Embodiment)

The first embodiment relates to a case where the color printer 200 is capable of moving an actively designated cartridge to the cartridge removal port based upon a cartridge-move command and type of designated cartridge (and cartridge information) supplied from the host computer 100.

Figure 4:
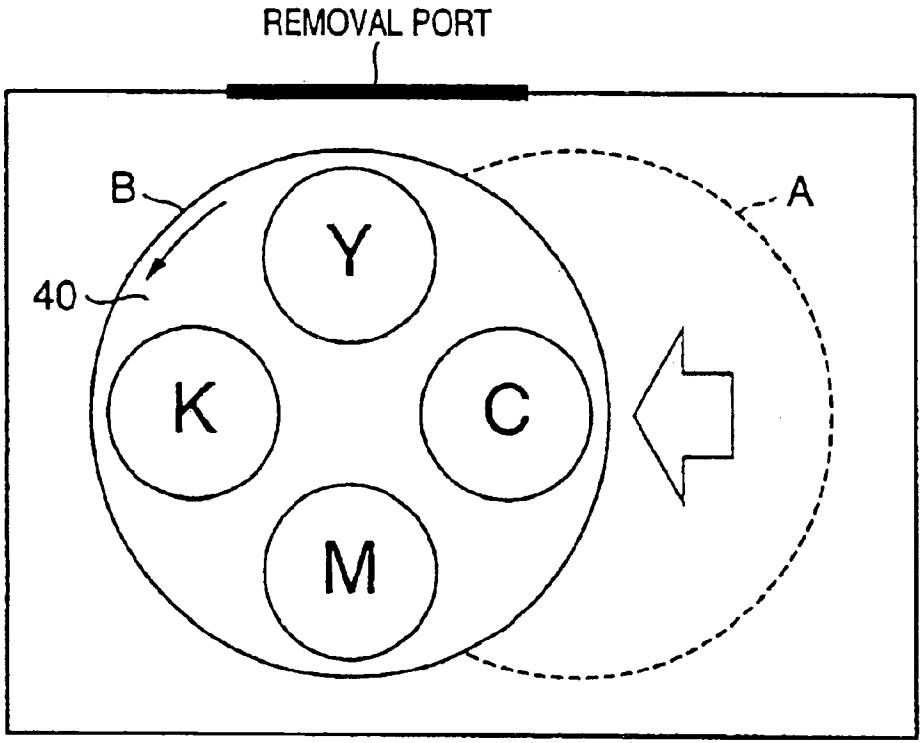
FIG. 4 PRIOR ART
FIG. 4 is a schematic diagram illustrating an example of the structure of a typical cartridge supporting body in a color image forming apparatus according to the prior art.

However, the color printer 200 may be of the type having an image forming unit in which cartridges can be moved only by an amount equivalent to one cartridge by a single execution of cartridge-move processing. (That is, if a cartridge supporting body having a structure of the kind shown in FIG. 4 is used, cartridges can be rotated only through 90' by a single execution of move processing.)

This embodiment is characterized in that the present invention is applied to the color printer 200 having such an image forming unit, and to a host computer 100 for controlling this color printer 200. The hardware implementation of the host computer 100 and of color printer 200 in this embodiment may be identical with that of the first embodiment. This hardware, therefore, need not be described again.

Figure 10:
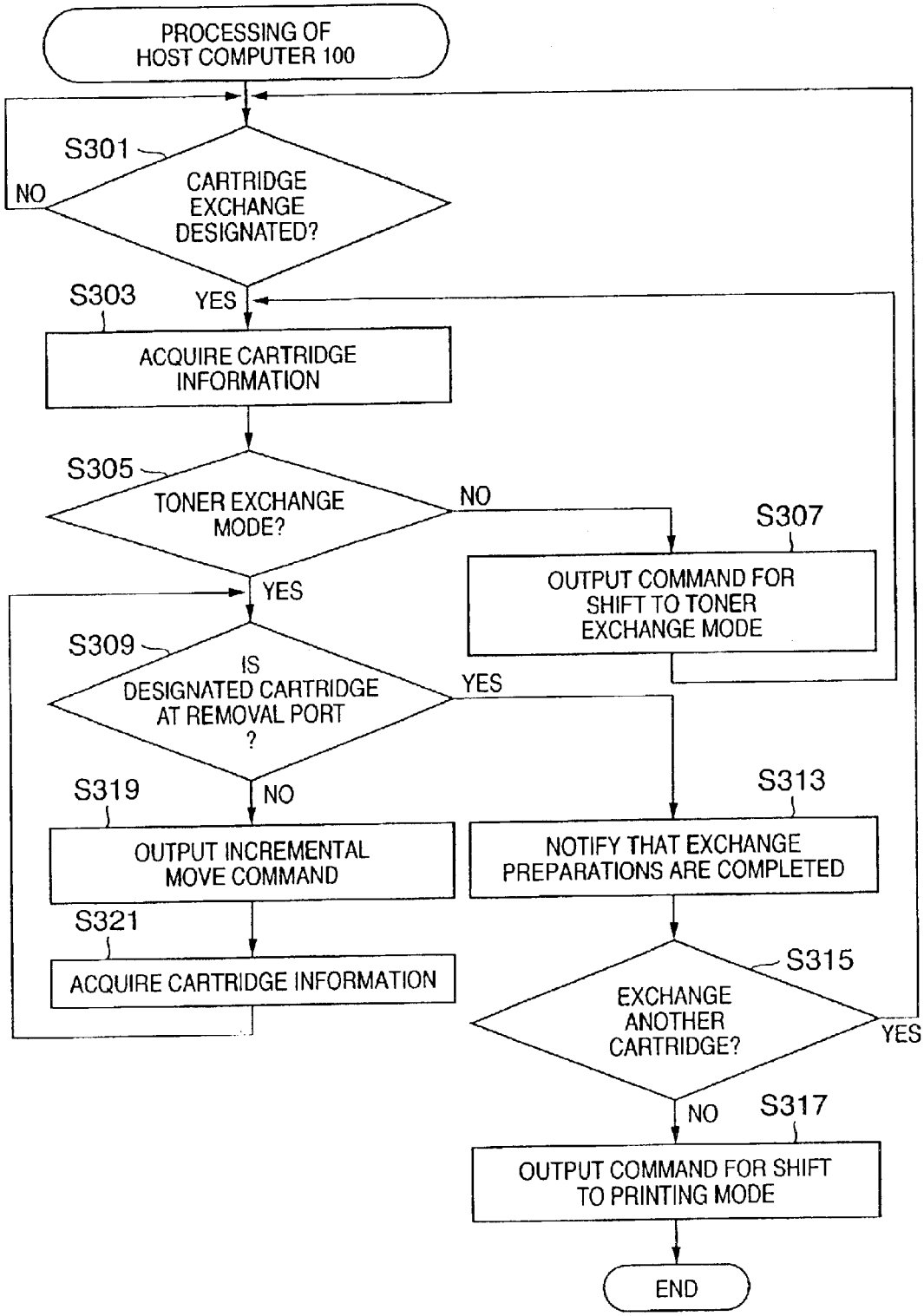
FIG. 10 is a flowchart illustrating the processing executed by the host computer according to a second embodiment of the present invention.

FIG. 10 is a flowchart illustrating processing executed on the side of the host computer 100 in this embodiment. Processing steps in FIG. 10 that are identical with those of the first embodiment are designated by processing steps numbers identical with those of FIG. 5. A comparison of FIGS. 5 and 10 shows that the processing of the two flowcharts is the same except for the case where it is determined at step S309 that the cartridge designated for exchange is not situated at the cartridge removal port. Accordingly, only the processing of steps S319 and S321 characterizing this embodiment will be described below.

A cartridge-move command is output to the color printer 200 at step S319. Unlike the first embodiment, this move command does not include the type of designated cartridge. After the cartridge-move command is output, cartridge information is acquired from the color printer 200 at step S321. Whether the desired cartridge is situated at the cartridge removal port is determined at step S309 based upon the cartridge information acquired. If the result of the determination is that the desired cartridge is found not to be situated at the cartridge removal port, then the cartridge-move command is re-issued and acquisition of information on the cartridge situated at the removal port is repeated.

It should be noted that the processing executed by the color printer 200 of this embodiment need not be described again as it is the same as that of the first embodiment except for the fact that the cartridge-move processing (step S411 in FIG. 8) is modified to move processing for simple incremental movement of the cartridges.

(Third Embodiment)

In the above embodiments, mainly the color printer is controlled by the host computer and processing for moving cartridges at the time of cartridge exchange is executed. However, it is permissible to adopt an arrangement in which the host computer merely outputs a cartridge command that includes the type of cartridge and control relating to cartridge movement is performed on the side of the color printer. In this case, the color printer 200 would be so adapted that the control processing executed by the host computer in the above embodiments is implemented by the cartridge management unit 123. More specifically, it will suffice for the program relating to this control processing to be stored in the program ROM 6.

Figure 11:
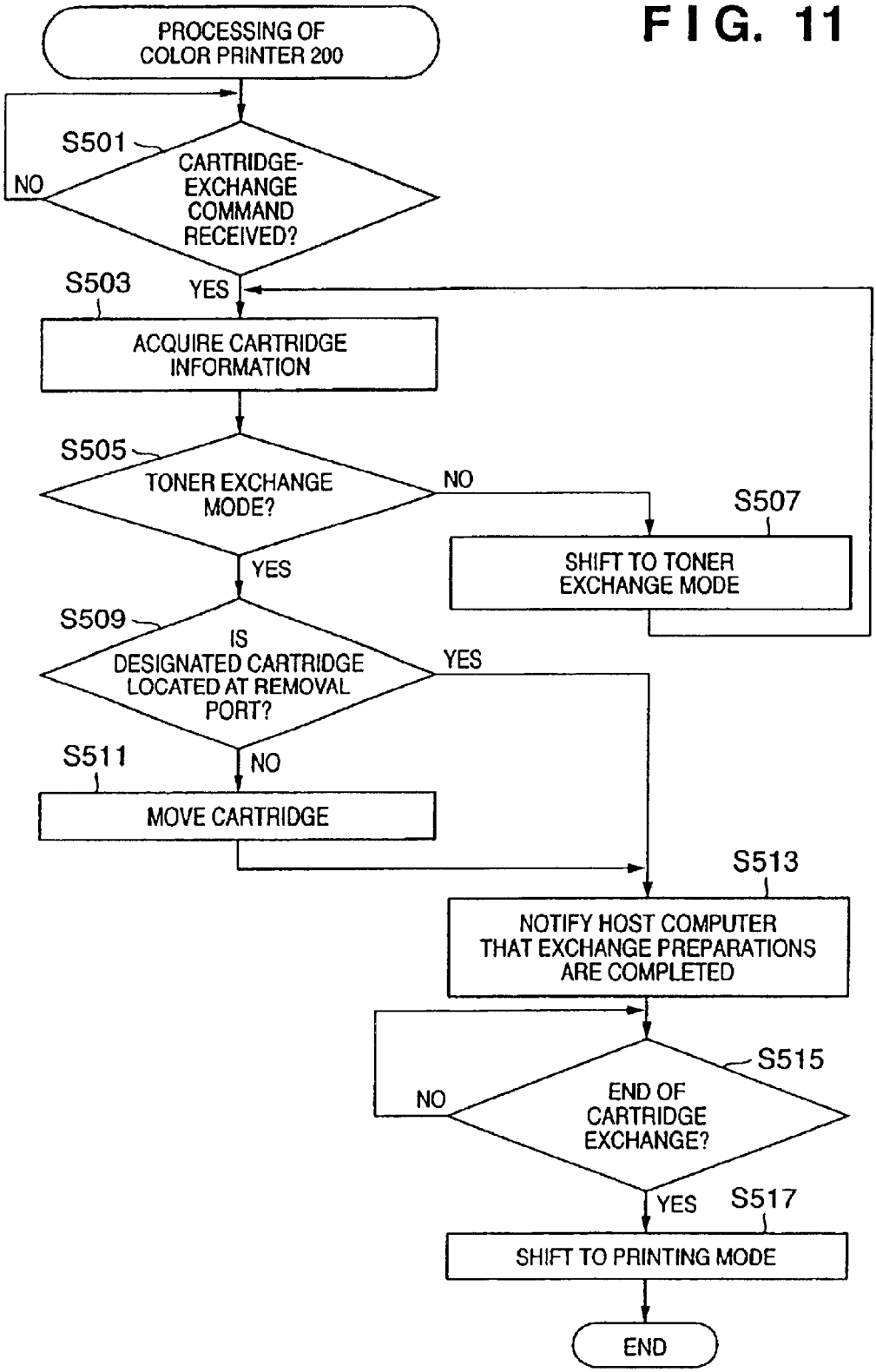
FIG. 11 is a flowchart illustrating the processing executed by the color printer according to a third embodiment according to the present invention.

FIG. 11 is a flowchart illustrating the operation of the color printer 200 according to this embodiment.

First, the color printer 200 determines whether a cartridge command indicating the type of designated cartridge has been received from the host computer 100 (step S501). If receipt of the command is confirmed, then cartridge information is acquired from the image forming unit 124 (step S503). If the prevailing mode is not the cartridge-exchange mode, ("NO" at step S505), then the color printer 200 shifts to the cartridge-exchange mode (step S507) and control returns to step S503.

If the color printer 200 is already in the cartridge-exchange mode ("YES" at step S505) the printer determines whether the cartridge designated by the received command is situated at the cartridge removal port (step S509). If the decision is "NO", then the cartridge is moved (step S511). The processing for moving cartridges can employ the processing described above in connection with FIG. 9. If the processing adopted is of the type described in the second embodiment in which the image forming unit 124 can move the cartridges only incrementally by an amount equivalent to one cartridge per execution of cartridge-move processing, then processing equivalent to that of steps S319 and S321 in FIG. 10 would be executed instead of step S511.

If movement of cartridges is completed and the designated cartridge has been moved to the cartridge removal port, then completion of exchange preparations is reported to the host computer 100 (step S513). If end of cartridge-exchange processing is determined, as when the status of the cartridge-exchange cover changes from open to closed or the host computer 100 sends notification that cartridge-exchanged processing has ended ("YES" at step S515), then the image forming unit 124 shifts to the printing mode (step S517) and processing is terminated.

Figure 12:
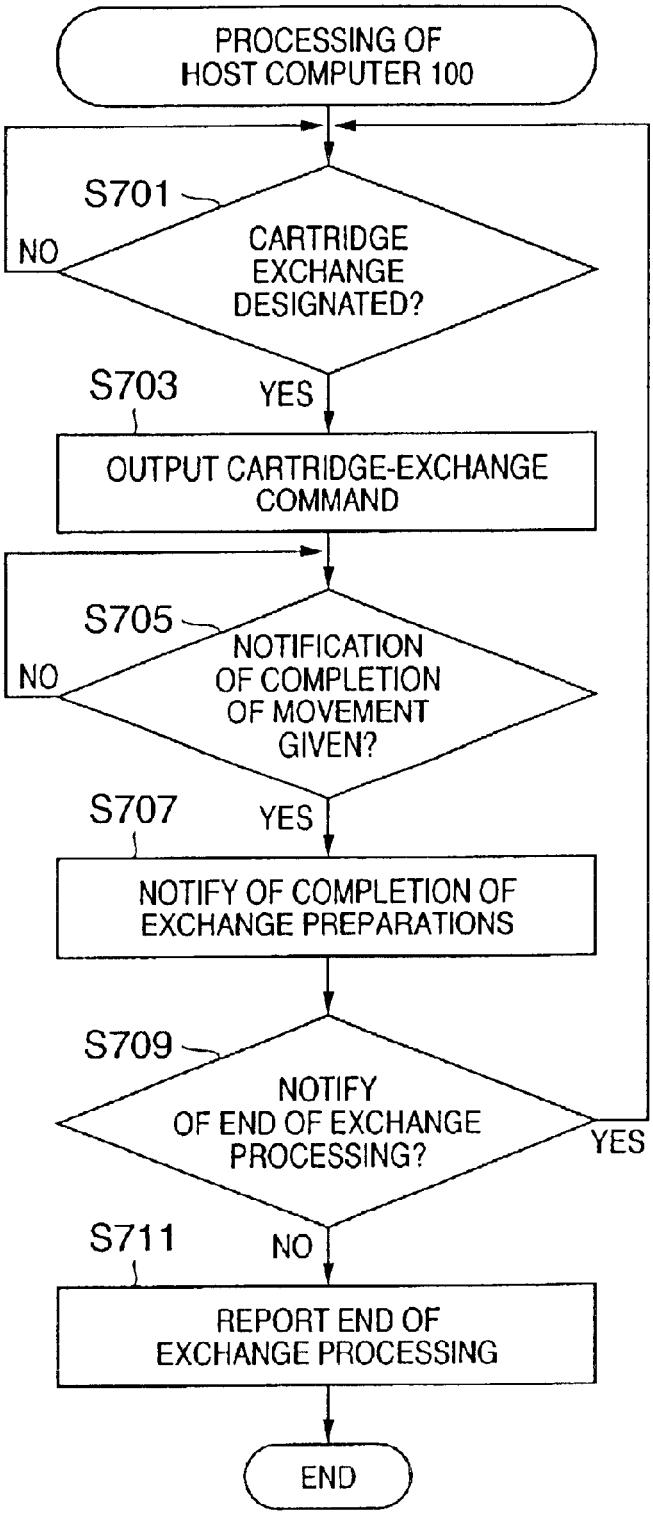
FIG. 12 is a flowchart illustrating the processing executed by the host computer according to the third embodiment.

FIG. 12 is a flowchart illustrating processing executed on the side of the host computer 100 according to this embodiment.

First, as in the above embodiment, the host computer waits for the user to designate cartridge exchange (step S701). If such a designation is made, then the computer generates a cartridge-exchange command that includes the type of cartridge designated for exchange and outputs this command to the color printer 200 (step S703).

The host computer waits for notification from the color printer 200 to the effect that movement has been completed (step S705). If receipt of such notification is detected ("YES" at step S705), then the host computer notifies the computer that preparations for exchange have been completed (step S707). If termination of exchange processing is specified by the user ("NO" at step S709), then end of exchange processing is reported to the color printer 200 (step S711). On the other hand, if exchange of another cartridge is specified ("YES" at step S709), control returns to step S701.

In the above embodiments, the invention is described with regard to a color printer that uses four toner cartridges. However, the present invention is applicable to any image forming apparatus that uses a plurality of removable cartridges. Specifically, the cartridges are not limited to toner cartridges and may be ink cartridges usable in an image forming apparatus used to form liquid ink into an image, or ink-ribbon cartridges usable in an image forming apparatus that employs a thermal-transfer-type ink ribbon. Further, any type of cartridge may be used if the image forming apparatus is one having a structure in which a plurality of cartridges may each be exchanged by moving them in succession. Examples are fixer-device cartridges, transfer cartridges and photosensitive-body cartridges. Different types of cartridges may of course be mixed.

In the foregoing embodiments, the present invention is described only with regard to the host computer 100 and color printer 200, each of which comprises a single device. However, the invention may be realized by a system comprising multiple devices having functions equivalent to those described above.

It should be noted that the present invention also covers a case where software programs for implementing the functions of the above embodiments (programs corresponding to flowcharts illustrated in any one or more of FIGS. 5 and 8 to 12 of the embodiments) are supplied directly from a recording medium, or through use of wired/wireless communication, to a system or apparatus having a computer that is capable of executing the above-mentioned programs, and the system or apparatus executes the supplied programs to thereby implement the equivalent functions.

Accordingly, program code per se supplied to and installed in a computer in order that the computer may execute the processing of the present invention also implements the invention. In other words, the computer program that implements the processing of the present invention also is covered by the present invention.

In this case, so long as the system or apparatus has the functions of the program, the form of the program, e.g., object code, a program executed by an interpreter or script data supplied to an operating system, etc., does not matter.

Examples of recording media by which the program can be supplied are magnetic recording media, such as a floppy disk, a hard disk and magnetic tape, optical/magneto-optical storage media, such as a magneto-optical disk, a CD-ROM, a CD-R, a CD-RW, a DVD-ROM, a DVD-R and a DVD-RW, and a non-volatile semiconductor memory.

As for the method of supplying the program using wired/wireless communication, the computer program itself for forming the present invention in the server of a computer network, or a data file (program-data file) that can serve as a computer program for forming the present invention in a client computer, such as a compressed file having an automatic install function, can be stored and the program-data file can be downloaded to a connected client computer. In such case the program-data file can be divided into a plurality of segment files and the segment files can be deployed at different servers.

In other words, the present invention also covers a server apparatus that allows multiple users to download a program-data file for the purpose of implementing the functions of the present invention by computer.

Further, it is also possible to encrypt and store the program of the present invention on a storage medium such as a CD-ROM, distribute the storage medium to users, allow users who meet certain requirements to download decryption key information from, e.g., a website via the Internet, and allow these users to run the encrypted program by using the key information, whereby the program is installed in the user computer.

Furthermore, besides the case where the aforesaid functions according to the embodiments are implemented by executing the read program by computer, an operating system or the like running on the computer can perform all or a part of the actual processing based upon commands in the program so that the functions of the foregoing embodiments are implemented by this processing.

Furthermore, after the program read from a recording medium is written to a function expansion board inserted into the computer or to a memory provided in a function expansion unit connected to the computer, a CPU or the like mounted on the function expansion board or function expansion unit can perform all or a part of the actual processing based upon commands in the program so that the functions of the foregoing embodiments can be implemented by this processing.

Thus, in accordance with the present invention as described above, it is possible to exchange a desired cartridge easily in an image forming apparatus that uses a plurality of removable cartridges.

Further, it is possible to lower the cost of the apparatus because a mechanism such as a cartridge exchange button provided on the conventional image forming apparatus is unnecessary.

Furthermore, the present invention can be applied to a system constituted by a plurality of devices or to an apparatus comprising a single device.

It goes without saying that the present invention can be implemented by supplying a program that executes the processes defined by the present invention.

What is claimed is:

1. An image forming apparatus comprising:

a plurality of removable cartridges;

a cartridge support configured to support said plurality of cartridges;

a cartridge support moving unit configured to move said cartridge support in a case where a cartridge supported on said cartridge support is to be removed from said image forming apparatus;

a control unit configured to control the operation of said cartridge support moving unit so as to move to a removable position one of said plurality of cartridges specified by a cartridge-move command received from an external unit; and an image forming device configured to form an image in case where said plurality of cartridges are supported by said cartridge support.

2. The image forming apparatus according to claim 1, further comprising:

a determining unit configured to determine whether the cartridge specified by the cartridge-move command received from the external unit, is situated at the removable position, and wherein said control unit further controls said cartridge support moving unit to move the cartridge specified by the cartridge-move command to the removable position in a case where said determining unit determines that the cartridge specified by the cartridge-move command is not situated at the removable position.

3. The image forming apparatus according to claim 1, further comprising:

a reporting unit configured to report to the external unit that the cartridge specified by the cartridge-move command received from the external unit is to be removed in a case where the movement of the cartridge specified by the cartridge-move command received from the external unit to the removable position is completed.

4. The image forming apparatus according to claim 1, further comprising:

a shifting unit configured to shift said image forming apparatus from a print mode to a cartridge-exchange mode according to a command for shifting received from the external unit, and wherein said control unit is configured to control the operation of said cartridge support moving unit in a case where said image forming apparatus is shifted into the cartridge-exchange mode.

5. The image forming apparatus according to claim 4, wherein said shifting unit shifts said image forming apparatus from the cartridge-exchange mode to the print mode in a case where a cover for permitting exchanging of the cartridge to be moved to the removable position is closed.

6. An image forming apparatus comprising:

a plurality of removable cartridges;

a cartridge support configured to support said plurality of cartridges;

a cartridge support moving device configured to move said cartridge support and to place one of said plurality of cartridges at a cartridge detachable position in case where a cartridge supported on said cartridge support is to be removed from said image forming apparatus;

a control device configured to control the operation of said cartridge support moving device in a case where a cartridge-move command issued by an external unit has been received; and an image forming device configured to form an image in a case where said plurality of cartridges are supported by said cartridge support, wherein said control device detects the type of cartridge, from among said plurality of removable cartridges, that is situated at the cartridge detachable position, and reports information on the type of cartridge detected to the external unit.

7. The image forming apparatus according to claim 6, wherein said control device includes:

a determining device configured to determine the cartridge type to be placed at the cartridge detachable position from the cartridge-move command issued by the external unit;

an acquisition device configured to acquire information on the type of cartridge placed at the cartridge detachable position; and a movement-amount decision device configured to decide the amount of movement of said cartridge support to place the cartridge, whose type has been determined by said determining device, at the cartridge detachable position in a case where the cartridge type determined by said determining device and the cartridge type acquired by said acquisition device do not match.

8. An information processing apparatus for transferring information to an image forming apparatus having a plurality of removable cartridges, comprising:

a cartridge designating unit configured to designate one of the plurality of removable cartridges; and a cartridge-move command issuing unit configured to issue to the image forming apparatus a cartridge-move command, to instruct moving one of the plurality of removable cartridges designated by said cartridge designating unit to a removable position.

9. The information processing apparatus according to claim 8, further comprising:

a notifying unit configured to perform a notification operation indicating that exchange of the cartridge designated by said cartridge designating unit is possible in a case where cartridge information from the image forming apparatus indicates that the cartridge, designated by said cartridge designating unit, is situated at the removable position.

10. The information processing apparatus according to claim 8, further comprising:

a mode shifting command issuing unit, configured to issue a mode-shifting command to shift the image forming apparatus from a print mode to a cartridge-exchange mode in a case where one of the plurality of removable cartridges is designated by said cartridge designating unit.

11. An information processing apparatus for transferring information to an image forming apparatus having a plurality of removable cartridges, comprising:

a cartridge designating command accepting device configured to accept a cartridge designating command that designates one of the plurality of removable cartridges;

a cartridge-move command issuing device configured to issue a cartridge-move command to the image forming apparatus based upon the cartridge designating command accepted by said cartridge designating command accepting device;

a cartridge information acquisition command issuing device configured to issue, to the image forming apparatus, a cartridge information acquisition command for instructing the image forming apparatus to acquire cartridge information on the cartridge situated at a cartridge detachable position of the image forming apparatus; and a cartridge information receiving device configured to receive the cartridge information issued by the image forming apparatus.

12. The information processing apparatus according to claim 11, further comprising a determination device configured to determine whether the cartridge information received by said cartridge information receiving device matches the cartridge information designated by the cartridge designating command accepted by said cartridge designating command accepting device.

13. The information processing apparatus according to claim 12, further comprising a notification device configured to notify a user that a cartridge situated at the cartridge detachable position is removable in a case where, as a result of the determination made by said determination device, the cartridge information designated by the cartridge designating command accepted by said cartridge designating command accepting device matches the cartridge information received by said cartridge information receiving device.

14. The information processing apparatus according to claim 12, wherein the cartridge-move command is re-issued to the image forming apparatus by said cartridge move-command issuing device in a case where, as a result of the determination made by said determination device, the cartridge information designated by the cartridge designating command accepted by said cartridge designating command accepting device does not match the cartridge information received by said cartridge information receiving device.

15. A method of controlling an image forming apparatus having a plurality of removable cartridges and a cartridge support for supporting the plurality of cartridges and for moving one of the plurality of cartridges to a removable position, said method comprising:

a receiving step of receiving a cartridge-move command from an external unit; and a control step of controlling movement of the cartridge support so as to move one of the plurality of cartridges specified by the cartridge-move command received from the external unit to the removable position.

16. The method of controlling an image forming apparatus according to claim 15, further comprising:

a determining step of determining whether the cartridge, specified by the cartridge-move command received from the external unit, is situated at the removable position, and wherein said control step further controls the movement of the cartridge support so as to move the cartridge specified by the cartridge-move command received from the external unit to the removable position in a case where the cartridge, determined in said determining step, is not situated at the removable position.

17. The method of controlling an image forming apparatus according to claim 15, further comprising:

a reporting step of reporting to the external unit that the cartridge specified by the cartridge-move command received from the external unit is to be removed in a case where the movement of the cartridge, specified by the cartridge-move command received from the external unit, to the removable position is completed.

18. The method of controlling an image forming apparatus according to claim 15, further comprising:

a shifting step of shifting the image forming apparatus from a print mode to a cartridge-exchange mode according to a command for shifting received from the external unit, and wherein said control step is configured to control movement of the cartridge support in a case where the image forming apparatus is shifted into the cartridge-exchange mode.

19. The method of controlling an image forming apparatus according to claim 18, wherein said shifting step shifts the image forming apparatus from the cartridge-exchange mode to the print mode in a case where a cover of the image forming apparatus for permitting exchanging of the cartridge specified by the cartridge-move command is closed.

20. An method of controlling an information processing apparatus for transferring information to an image forming apparatus having a plurality of removable cartridges, comprising:

a cartridge designating step of designating one of the plurality of removable cartridges; and a cartridge-move command issuing step of issuing a cartridge-move command to the image forming apparatus, to instruct the image forming apparatus to move one of the plurality of removable cartridges designated in said cartridge designating step to a removable position.

21. The method for controlling an information processing apparatus according to claim 20, further comprising:

a notifying step of performing a notification operation indicating that exchange of the cartridge designated by said cartridge designating step is possible in a case where cartridge information from the image forming apparatus indicates that the cartridge, designated in said cartridge designating step, is situated at the removable position.

22. The method of controlling an information processing apparatus according to claim 20, further comprising:

a mode shifting command issuing step of issuing a mode-shifting command to shift the image forming apparatus from a print mode to a cartridge-exchange mode in a case where a cartridge is designated in said cartridge designating step.

23. A control program for controlling an information processing apparatus for transferring information to an image forming apparatus having a plurality of removable cartridges, said control program causing a computer to execute the following steps:

a cartridge designating step of designating one of the plurality of removable cartridges; and a cartridge-move command issuing step of issuing a cartridge-move command to the image forming apparatus, to instruct the image forming apparatus to move one of the plurality of removable cartridges designated in said cartridge designating step to a removable position.

24. The control program for controlling an information processing apparatus according to claim 23, further comprising:

a notifying step of performing a notification operation indicating that exchange of the cartridge designated in said cartridge designating step is possible in a case where cartridge information from the image forming apparatus indicates that the cartridge, designated in said cartridge designating step, is situated at the removable position.

25. The control program for controlling an information processing apparatus according to claim 23, further comprising:

a mode shifting command issuing step of issuing a mode-shifting command to shift the image forming apparatus from a print mode to a cartridge-exchange mode in a case where a cartridge is designated in said cartridge designating step.

* * * * *

UNITED STATES PATENT AND TRADEMARK OFFICE

CERTIFICATE OF CORRECTION

PATENT NO. : 6,850,716 B2
DATED : February 1, 2005
INVENTOR(S) : Shukei Kurihara It is certified that error appears in the above-identified patent and that said Letters Patent is hereby corrected as shown below:

Column 4,
Line 25, “accord-” should read -- of --.
Line 26, “ing to” should be deleted.

Column 7,
Line 19, “case” should read -- a case --.
Line 63, “90’” should read -- 90° --.

Column 8,
Line 3, “color” should read -- the color --.

Column 11,
Line 19, “case” should read -- a case --.
Line 25, “unit,” should read -- unit --.
Line 62, “case” should read -- a case --.

Signed and Sealed this

Seventh Day of June, 2005

JON W. DUDAS
*Director of the United States Patent and Trademark Office*